US006985683B2

(12) United States Patent
Foster et al.

(10) Patent No.: US 6,985,683 B2
(45) Date of Patent: Jan. 10, 2006

(54) METHOD OF MITIGATING TONER DAMAGE IN HIGH SPEED CONTACT DEVELOPING WITH END SEAL

(75) Inventors: Mark Duane Foster, Lexington, KY (US); James Christopher Piotrowski, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 147 days.

(21) Appl. No.: 10/701,853

(22) Filed: Nov. 5, 2003

(65) Prior Publication Data

US 2005/0095030 A1 May 5, 2005

(51) Int. Cl.
*G03G 15/08* (2006.01)

(52) U.S. Cl. ..... 399/103; 399/279

(58) Field of Classification Search ..... 399/102, 399/103, 105, 279, 286
See application file for complete search history.

(56) References Cited

U.S. PATENT DOCUMENTS

| | | | | |
|---|---|---|---|---|
| 5,202,729 | A * | 4/1993 | Miyamoto et al. | 399/103 |
| 5,485,344 | A | 1/1996 | Matsumoto et al. | |
| 5,874,172 | A | 2/1999 | Beach et al. | |
| 5,914,742 | A | 6/1999 | Weidert | |
| 6,405,003 | B2 * | 6/2002 | Uehara | 399/103 |
| 6,487,383 | B2 | 11/2002 | Buchanan et al. | |
| 6,654,576 | B2 * | 11/2003 | Dougherty | 399/103 |
| 6,690,900 | B2 * | 2/2004 | Dougherty et al. | 399/103 |

* cited by examiner

*Primary Examiner*—William J. Royer
(74) *Attorney, Agent, or Firm*—John S. Brady

(57) ABSTRACT

A developer roller (5) is rotated rapidly for high speed printing, which can cause excessive heating at end seal (1). Heat damage to toner (24) is avoided by providing gaps (30*a*, 30*b*) under the seals (1) which reduce the stiffness of developer roller (5) and thereby reduce frictional heating.

2 Claims, 3 Drawing Sheets

METHOD OF MITIGATING TONER DAMAGE IN HIGH SPEED CONTACT DEVELOPING WITH END SEAL

TECHNICAL FIELD

This invention relates to xerographic imaging by interaction between a developer roller and a photoconductor roller having an electrostatic image rotating at high speeds, the developer roller having an end seal subject to frictional heating.

BACKGROUND OF THE INVENTION

A common method of development with toner of an electrostatic image on a photoconductor roller (typically termed a drum) is by a developer roller moved in contact with the photoconductor roller. The developer roller has toner applied to it and holds a layer of toner by electrostatic attraction. The developer roller rotates past a doctor blade, which may also have an electrical charge, and then contacts the rotating photoconductor roller.

In this configuration a source of toner is located on the side of the developer roller opposite the photoconductor roller. Seals of various kinds are employed to prevent this toner from escaping from the sides of the developer roller. Typically the seal is a member that is shaped to fit the contour of the developer roller and is resilient so that it can be firmly pressed between the end of the developer roller and a frame member. Some such seals take the form of a letter J and are often termed J-seals.

The friction of the developer roller moving against such a seal, which is essentially stationary, creates increased temperatures as printing speeds are increased by rotating the developer roller and the photoconductor roller faster. The temperatures become a serious technical concern when they rise to the point of melting or otherwise degrading the toner. The melting of toner will cause catastrophic failure of imaging.

This problem has apparently not been addressed in the prior art. However, as printing speeds increase, an avoidance of the unacceptable temperatures from seal friction is needed.

DISCLOSURE OF THE INVENTION

This invention employs the recognition that the developer roller exists under the seal only to contain toner, not for development purposes. That being true, an internal weakening of the developer roller immediately under the seal will not degrade the imaging operation.

In accordance with this invention the developer roller immediately under the seal is reduced in stiffness. In an embodiment, a void area is located on the developer roller between a supporting shaft of the developer roller and an outer part of the developer roller. Since that outer part will flex inward somewhat during use, friction between the developer roller and the seal is reduced. In a typical implementation of this invention, the difference in temperature between a developer roller of standard configuration and a developer roller having a gap under the seal was 13.5%.

BRIEF DESCRIPTION OF THE DRAWINGS

The details of this invention will be described in connection with the accompanying drawings, in which.

DESCRIPTION OF THE PREFERRED EMBODIMENTS

Figure 1:
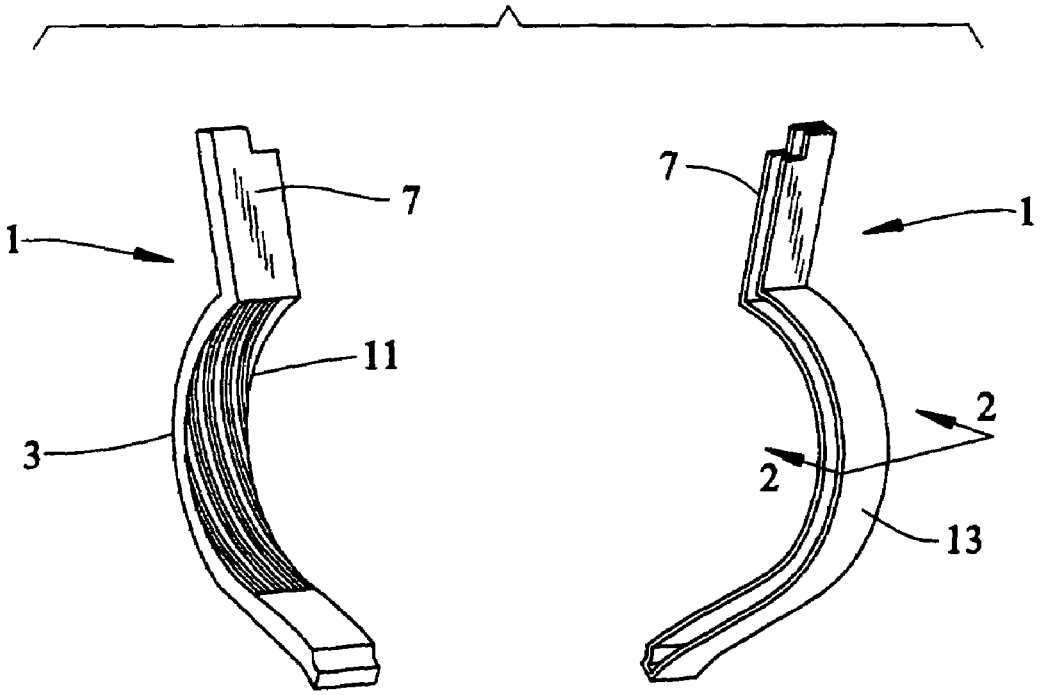
FIG. 1 (PRIOR ART)
FIG. 1 shows front and back isometric views of a seal employed in a representative embodiment of this invention, which are not novel in themselves and which are therefore labeled as prior art.

Although only pertinent parts are shown in the drawings, it will be readily understood that the other parts complete a standard laser printer imaging device, such as described in U.S. Pat. No. 6,487,383 B2 assigned to the same assignee to which this invention is assigned. That patent is prior art with respect to this invention. For added clarity, FIGS. 1 through 4 of this specification are based on figures of that patent.

A representative seal 1 employed in this invention is shown in FIG. 1. The front side of seal 1 has a curved portion 3, which conforms to the surface of the developer roller 5 (see FIG. 3) and a flat surface 7 which conforms to the surface of a doctor blade 9 (see FIG. 4). The front side of the seal has a region 11 with ridges to guide toner as described in detail in the foregoing U.S. Pat. No. 6,487,383B2. The region 11 contacts the developer roller 5.

Figure 2:
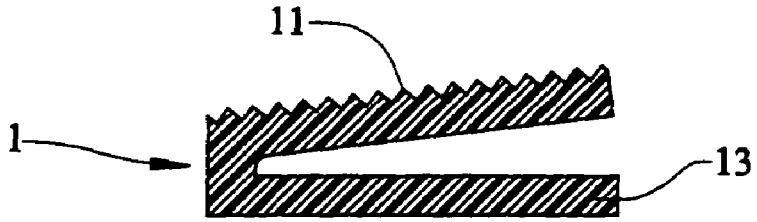
FIG. 2 (PRIOR ART)
FIG. 2 is a cross-sectional view of the seal of FIG. 1 taken at line 2—2, also labeled prior art.

As shown in FIG. 2, the back side of the seal 13 forms a cantilever configuration with curved portion 3 and flat surface 7 (FIG. 1). This provides a spring effect to press the front side against the developer roller 5 and the doctor blade 9.

Seals are typically resilient material, although they may take many forms. Ridges 11 improve sealing action but may not be necessary in many instances. A preferred seal as illustrated is made from artificial rubber.

Figure 3:
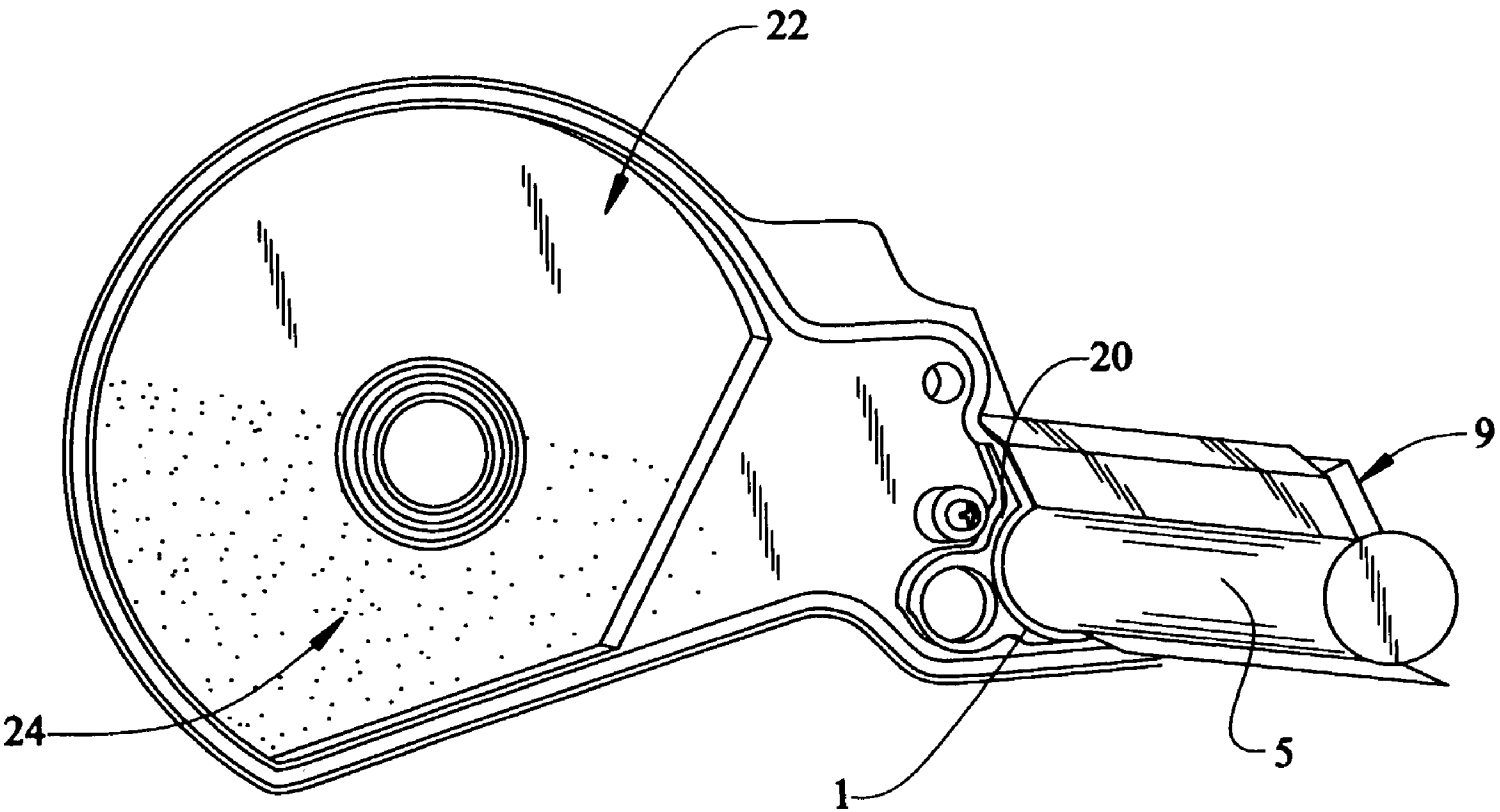
FIG. 3 (PRIOR ART)
FIG. 3 is a cut away sectional view showing the placement of the seal in a process cartridge, which is not novel in itself and is therefore labeled as prior art.

As shown in FIG. 3, seal 1 is mounted between an edge of frame 20, to which the back side 13 of seal 1 conforms, and developer roller 5 and doctor blade 9. The edge of frame 20 is part of a laser printer imaging device (not fully shown), and, more specifically, part of a toner cartridge (not fully shown) installed in a laser printer. Shown is one side wall 22 of a toner cartridge that forms a chamber for toner 24 (suggested by the dotted area) along with other walls of the cartridge (not shown).

Toner 24 is pushed out of the region opposite side wall 22 into contact with a toner adder roller (not shown) to thereby continuously be applied as a layer of toner 24 to developer roller 5, as is conventional. Doctor blade 9 controls further the layer of toner 24 on developer roller 5 as it rotates to bring toner to developer roller 24 (see FIG. 4)

Figure 4:
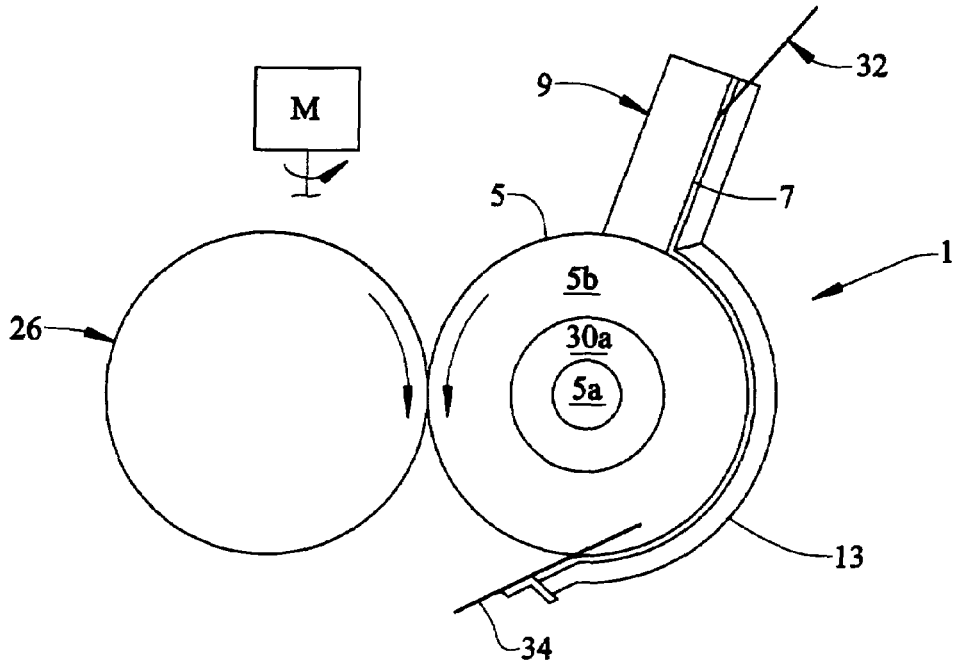
FIG. 4 is a side view of a developer roller seal, a developer roller, and a photoconductor drum, cross-sectioned through a seal to show the internal gap under the seal, with arrows showing motion.

FIG. 4 is a cross-sectional view through the seal 1. Developer roller 5 has a center support shaft 5*a*, which typically is steel. As the view is of that region under seal 1, FIG. 4 shows a circular gap 30*a* surrounding shaft 5*a*. The core material 5*b* mounted on shaft 5*a* forms the body of developer roller 5. FIG. 4 also shows known flap elements, upper element 32 and lower element 34, which are part of the sealing of toner 24 from escaping past the sides of developer roller 5 and doctor blade 9.

As is standard the developer roller 5 and photoconductor roller 26 are rotated through a motor, shown illustratively as element M, in the laser printer imaging device. The developer roller 5 and photoconductor 26 contact one another while moving in the same direction at the location of contact, as shown by arrows in FIG. 4. Typically developer roller 5 is rotated marginally faster than the speed of photoconductor roller 26 to provide some rubbing action. This speed differential does not cause detrimental frictional heating.

When the speed of developer roller 5 is relatively high to achieve higher speed printing (more pages per minute), the frictional heating between seal 1 and developer roller 5 can be sufficient to melt toner 24 or otherwise seriously degrade toner 24. It is that effect which this invention mitigates.

Figure 5:
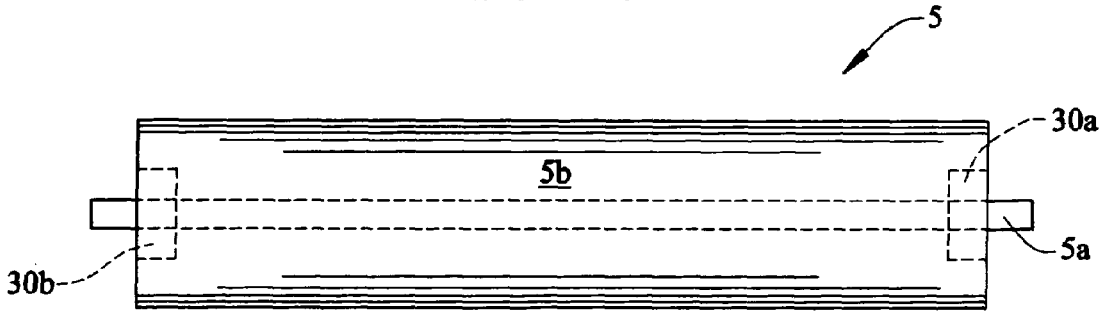
FIG. 5 shows the developer roller with dotted outlines illustrating the weakened portions or gaps under the seals at each end.

FIG. 5 shows just the developer roller 5 in accordance with this embodiment. Except for gaps 30*a* and 30*b* on each end, developer roller 5 may be essentially as described in U.S. Pat. No. 5,874,172 to Beach et al., which is assigned to the assignee of this invention. That developer roller of the foregoing Beach et al. patent has a core material corresponding to core material 5*b* that is a polycaprolactone ester polyurethane, having some polydiol with an outer layer, more-electrically-resistive-layer of oxidized polydiene. (The drawings of this application do not separately illustrate the outer layer of oxidized polydiene).

In accordance with this invention each end of developer roller 5 has gaps 30*a* and 30*b* between shaft 5*a* and the outer body of core material 5*b*. These gaps 30*a* and 30*b* are only at the ends, which is located where development by developer roller 5 is not employed.

Although gaps 30*a* and 30*b* are employed, it will be recognized that the air in gaps 30*a* and 30*b* is not necessary to functioning so long as material in the gap is soft enough to allow added flexibility to the part of core material 5*a* located under the seal 1 or other seal. For example, gaps 30*a* and 30*b* might be filled with a foam or a soft rubber-like insert.

Similarly, the configuration of the gaps 30*a* and 30*b* can take many shapes, all of which regulate the resulting stiffness of the core material 5*b* when it contacts the seal 1. Gaps 30*a* and 30*b* increased in the longitudinal direction (in the direction of shaft 5*a*) have reduced stiffness because the cantilever effect is enhanced. Gaps 30*a* and 30*b* increased laterally (i.e., reducing the thickness of core material 5*b* under the seal 1, have reduced stiffness because of the reduced support material.

Accordingly, the interaction of heat produced and toner damage during operation can essentially define this invention. The invention requires areas of reduced support under the seal or seals. If during normal operation of an identical roller without the areas of reduced support the toner is damaged significantly by heat, then the roller with reduced support under the seal or seals is an implementation of this invention.

What is claimed is:

1. A method of imaging at high speeds in a xerographic imaging device having a rotating imaged photoconductor roller, a developer roller, and toner in a chamber which supplies toner to said developer roller, and at least one seal located in contact with said developer roller to contain toner, the step of:

developing images on said photoconductor roller by rotating said developer roller past said photoconductor roller, said developer roller having a region under said seal which reduces the stiffness under said seal so that significant frictional heat damage to said toner which would occur without said region which reduces stiffness does not occur.

2. A method of imaging at high speeds in a xerographic imaging device having a rotating imaged photoconductor roller, a developer roller, and toner in a chamber which supplies toner to said developer roller, and at least one seal located in contact with said developer roller to contain toner, the step of:

developing images on said photoconductor roller by rotating said developer roller past said photoconductor roller, said developer roller having a gap under said seal which reduces the stiffness under said seal so that significant frictional heat damage to said toner which would occur without said gap which reduces stiffness does not occur.

* * * * *